US009447934B2

(12) United States Patent
Kim

(10) Patent No.: US 9,447,934 B2
(45) Date of Patent: Sep. 20, 2016

(54) OUTDOOR CAMPING LAMP WITH SOCKET ASSEMBLY HAVING BATTERY INSTALLING BRACKET

(71) Applicant: NINGBO TENGLONG OUTDOOR IMPLEMENT CO., LTD., Ningbo (CN)

(72) Inventor: Paul Youngcho Kim, Westminster, CA (US)

(73) Assignee: NINGBO TENGLONG OUTDOOR IMPLEMENT CO., LTD., Ningbo (CN)

( * ) Notice: Subject to any disclaimer, the term of this patent is extended or adjusted under 35 U.S.C. 154(b) by 36 days.

(21) Appl. No.: 14/205,616

(22) Filed: Mar. 12, 2014

(65) Prior Publication Data

US 2014/0268707 A1 Sep. 18, 2014

(30) Foreign Application Priority Data

Mar. 12, 2013 (CN) ..... 2013 1 0078926

(51) Int. Cl.
*F21L 14/00* (2006.01)
*F21L 4/00* (2006.01)
*F21L 19/00* (2006.01)

(52) U.S. Cl.
CPC . *F21L 4/00* (2013.01); *F21L 19/00* (2013.01)

(58) Field of Classification Search
CPC ..... F21L 4/00; F21L 4/005; F21L 4/02; F21L 4/022; F21L 4/025; F21L 4/027; F21L 4/04; F21L 4/045; F21L 4/06; F21L 4/08; F21L 4/085; F21L 11/00; F21V 21/406
USPC ..... 362/188, 194, 208
See application file for complete search history.

(56) References Cited

U.S. PATENT DOCUMENTS 5,860,729 A * 1/1999 Bamber ..... F21L 4/02 362/184
6,290,367 B1 * 9/2001 Greenhoe ..... F21L 4/00 362/183
7,347,582 B1 * 3/2008 Kung ..... F21L 4/00 362/177
8,066,401 B2 * 11/2011 Leung ..... F21L 4/00 362/157

* cited by examiner

*Primary Examiner* — Robert May
(74) *Attorney, Agent, or Firm* — Pearne & Gordon LLP

(57) ABSTRACT

An outdoor camping lamp, which comprises a handle, a top cover, a shade, a lamp socket assembly and a plurality of batteries, the lamp socket assembly includes a lamp socket, a housing, a battery installing bracket and a bottom support, the upper end of the lamp socket is connected with the lower end of the shade, the lower end of the lamp socket is connected with the upper end of the housing, the upper end of the battery installing bracket is connected to the lower end surface of the lamp socket, and the lower end of the battery installing bracket is connected to the upper end surface of the bottom support; both the battery installing bracket and the bottom support are arranged in the housing. With this structure, it is more convenient for replacing the batteries, and parts loss can be avoided, thereby ensuring normal working.

3 Claims, 4 Drawing Sheets

OUTDOOR CAMPING LAMP WITH SOCKET ASSEMBLY HAVING BATTERY INSTALLING BRACKET

THE TECHNICAL FIELD

The present invention generally relates to the field of outdoor articles, and particularly to an outdoor camping lamp.

THE BACKGROUND ART

An outdoor camping lamp is a kind of mobile instrument which can be used to provide lighting in the camps, scare away wild animals, indicate the location of the camp, and so on, and it is suitable for home lighting, carports, guard rooms, dormitory, farmhouse courtyards, greenhouse farming, fish boats, military posts, field duty, camping, geological exploration and other places. An outdoor camping lamp typically comprises a handle, a top cover, a shade, a lamp socket, a bottom cover and a battery case, wherein the handle is mounted at the side of the top cover, the top cover is connected to the upper end of the shade, the lower end of the shade is connected to the upper end of the lamp socket, the lower end of the lamp socket is connected with the bottom cover, a light emitting body is mounted on the lamp socket in the shade, and the battery case is installed in the lamp socket and electrically connected with the light emitting body. Usually, several batteries are provided in the battery case so as to supply the power for a long time. However, the outdoor camping lamp with this structure has the following disadvantages:

1) Since the bottom cover in the prior art can usually be disengaged from the lamp socket, when replacing the batteries of the camping lamp, the user has to unscrew the bottom cover from the lamp socket, takes out the battery pack from the end of the lamp socket, puts in the new battery pack and screws the bottom cover. But, in the dark outdoor environment, the bottom cover can not often be found after being unscrewed. Once the bottom cover loses, the battery pack can't supply the power, and the camping lamp can't work normally;

2) Since there are requirements for the placement of the batteries in the battery case, such as the installation and connection of the positive and negative poles, when replacing the batteries, the user has to align the positions and then performs installation and fixation. Especially, only when the positive and negative poles of respective batteries are put correctly one by one, the camping lamp can work normally. But, when in the dark environment, it is time- consuming and laborious for the user to correctly replace the battery pack and even the phenomenon of installation errors occur.

SUMMARY

The technical problem to be solved by the present invention is to provide an outdoor camping lamp in which the batteries can be replaced more conveniently, the parts missing can be avoided, and thus normal working is ensured.

To solve the above problem, the present invention provides an outdoor camping lamp, which comprises a handle, a top cover, a shade, a lamp socket assembly and a plurality of batteries. The handle is mounted on the side wall of the top cover, the top cover is connected to the upper end of the shade, the lower end of the shade is connected to the upper end of the lamp socket assembly, and a light emitting body is mounted on the lamp socket assembly within the shade.

The lamp socket assembly includes a lamp socket, a housing, a battery installing bracket and a bottom support, the upper end of the lamp socket is connected with the lower end of the shade, the lower end of the lamp socket is connected with the upper end of the housing, the upper end of the battery installing bracket is connected to the lower end surface of the lamp socket, and the lower end of the battery installing bracket is connected to the upper end surface of the bottom support. Both of the battery installing bracket and the bottom support are arranged in the housing.

A boss is provided at the lower end of the lamp socket, the outer peripheral wall of the boss has external thread, and the upper end of the housing has internal thread engaged to the external thread of the boss. The outer periphery of the bottom support has external thread engaged to the internal thread at the upper end of the housing.

The battery installing bracket comprises a central column and a plurality of spacers in radial distribution. Both the upper ends of the central column and the spacers are connected with the lower end surface of the boss. Both the lower ends of the central column and the spacers are connected with the upper end surface of the bottom support. The number of the spacers equals to the number of the batteries. Each battery is sandwiched between two adjacent spacers, and each battery is connected with the bottom support via respective springs. The lower ends of the springs are fixedly connected to the bottom support.

A nick is arranged at the side of each spacer away from the central column.

A plurality of lugs is uniformly arranged at the outer periphery wall of the lower end of the housing along the outer periphery.

Compared with the prior art, the present invention with the above structure has the following advantages:

1) In the lamp socket assembly according to the present invention, the housing is obstructed by the bottom support after being disengaged from the lamp socket, and the housing will not be completely disengaged from the socket assembly, therefore, parts loss does not occur even no light in outdoor environment, after replacing the new battery pack and tightly screwing the housing and the lamp socket, the camping lamp can normally work;

2) In addition, when replacing the battery, after the housing is unscrewed from the lamp socket and the battery installing bracket is exposed, the battery installing bracket is composed of the central column and the plurality of spacers in radial distribution, the batteries are clamped between two adjacent spacers, respectively, in the vertical direction of the battery installing bracket from the side thereof, and springs are also mounted on the bottom support beneath the battery installing bracket, therefore, when intending to install the battery, the user just needs to arrange the battery with the flat end downwards and the protrude end upwards, and then move up the housing and tightly screw it with the lamp socket. Therefore, the battery replacement is very convenient, and the phenomenon of installation errors will not occur;

3) In addition, a nick is arranged at the side of the respective spacers on the battery installing bracket away from the central column, so as to facilitate handing when the user takes out or puts in the batteries;

4) External thread engaged to the inner thread of the upper end of the housing is arranged around the outer peripheral wall of the bottom support, therefore, after being disengaged from the lamp socket, the housing can not be completely disengaged from the bottom support due to being obstructed by the external thread of the bottom support, then parts loss in dark outdoor environment is avoided.

Wherein: 1-handle; 2-top cover; 3-shade; 4-light emitting body; 5-lamp socket; 5.1-boss; 6-housing; 6.1-lug; 7-battery; 8-spring; 9-bottom support; 10-spacer; 10.1-nick; 11-central column

DETAILED DESCRIPTION

Hereinafter, the present invention will be further described in detail with reference to figures and the embodiment.

Figure 1:
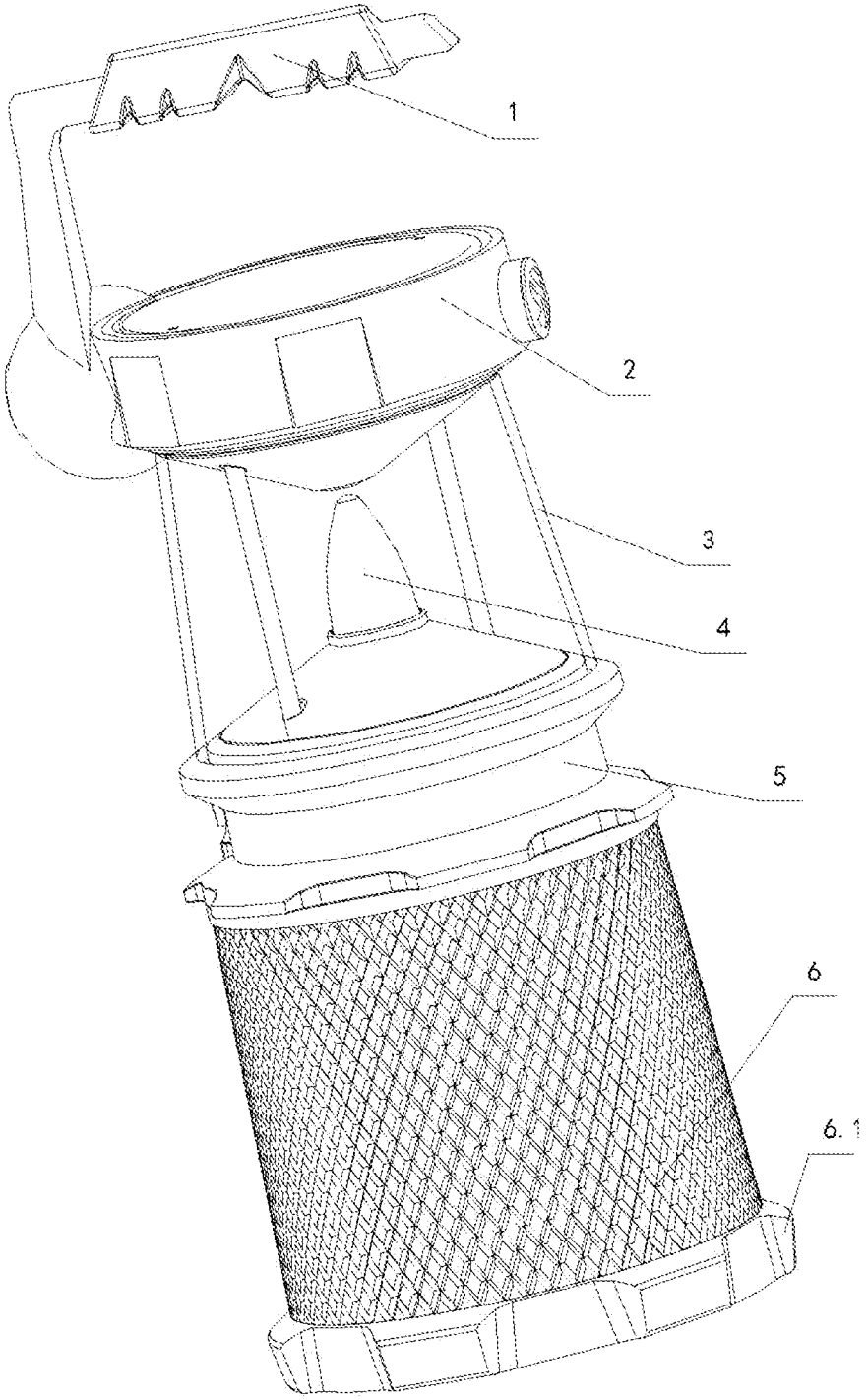
FIG. 1 is a three-dimensional schematic diagram of the outdoor camping lamp according to the present invention.
Figure 2:
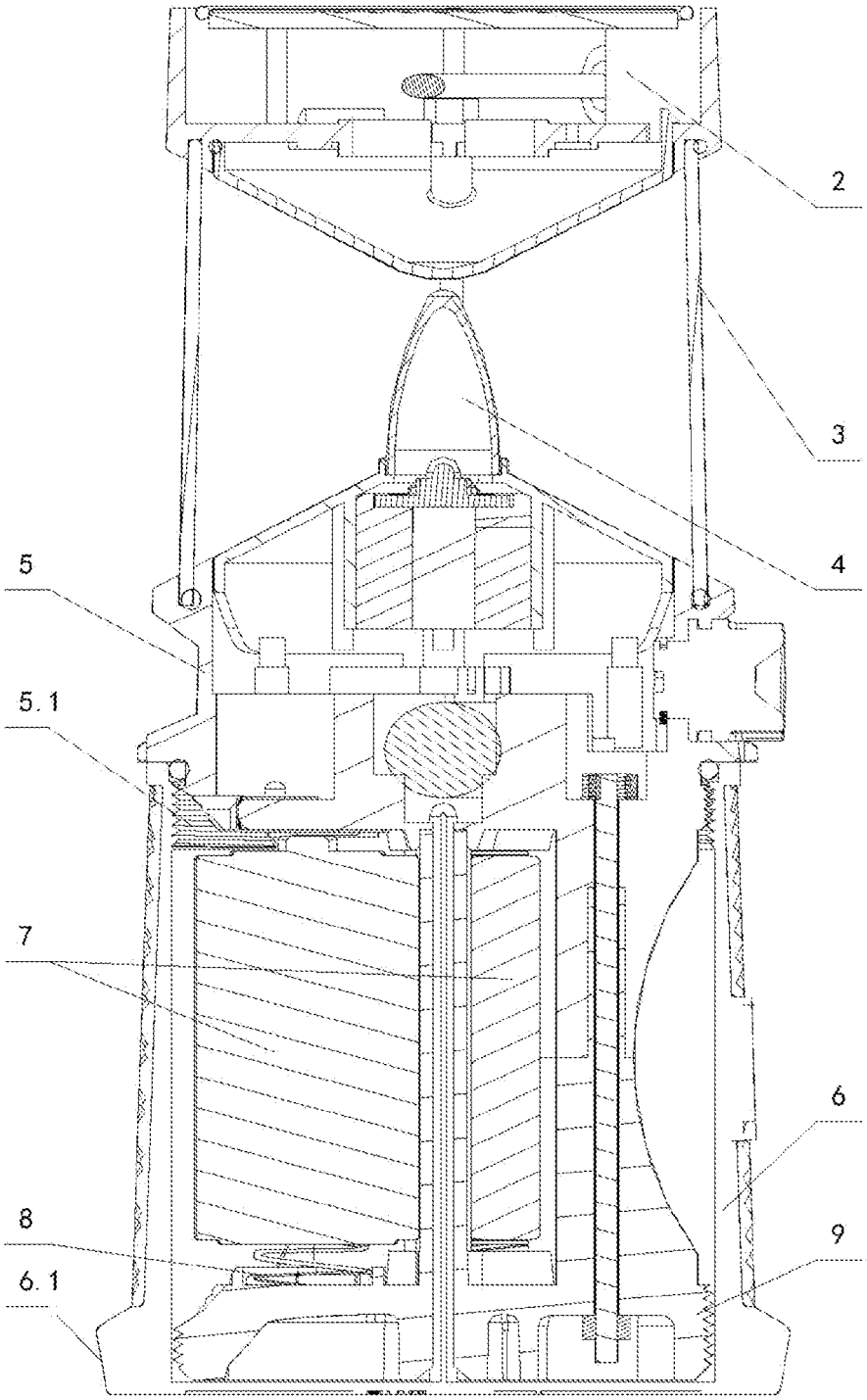
FIG. 2 is a cross-sectional schematic diagram of the outdoor camping lamp according to the present invention.
Figure 3:
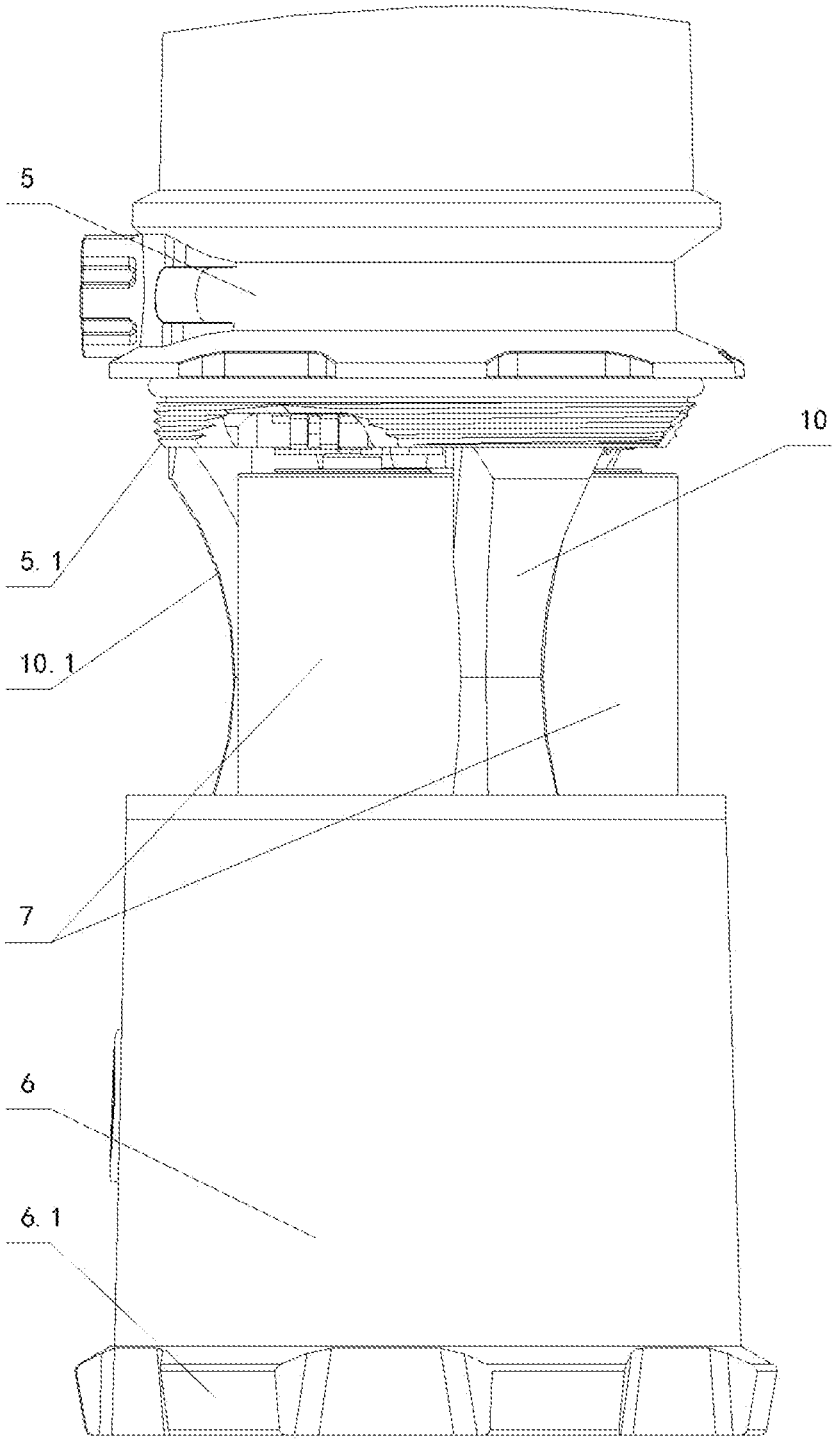
FIG. 3 is a schematic diagram showing the outdoor camping lamp in use according to the present invention.
Figure 4:
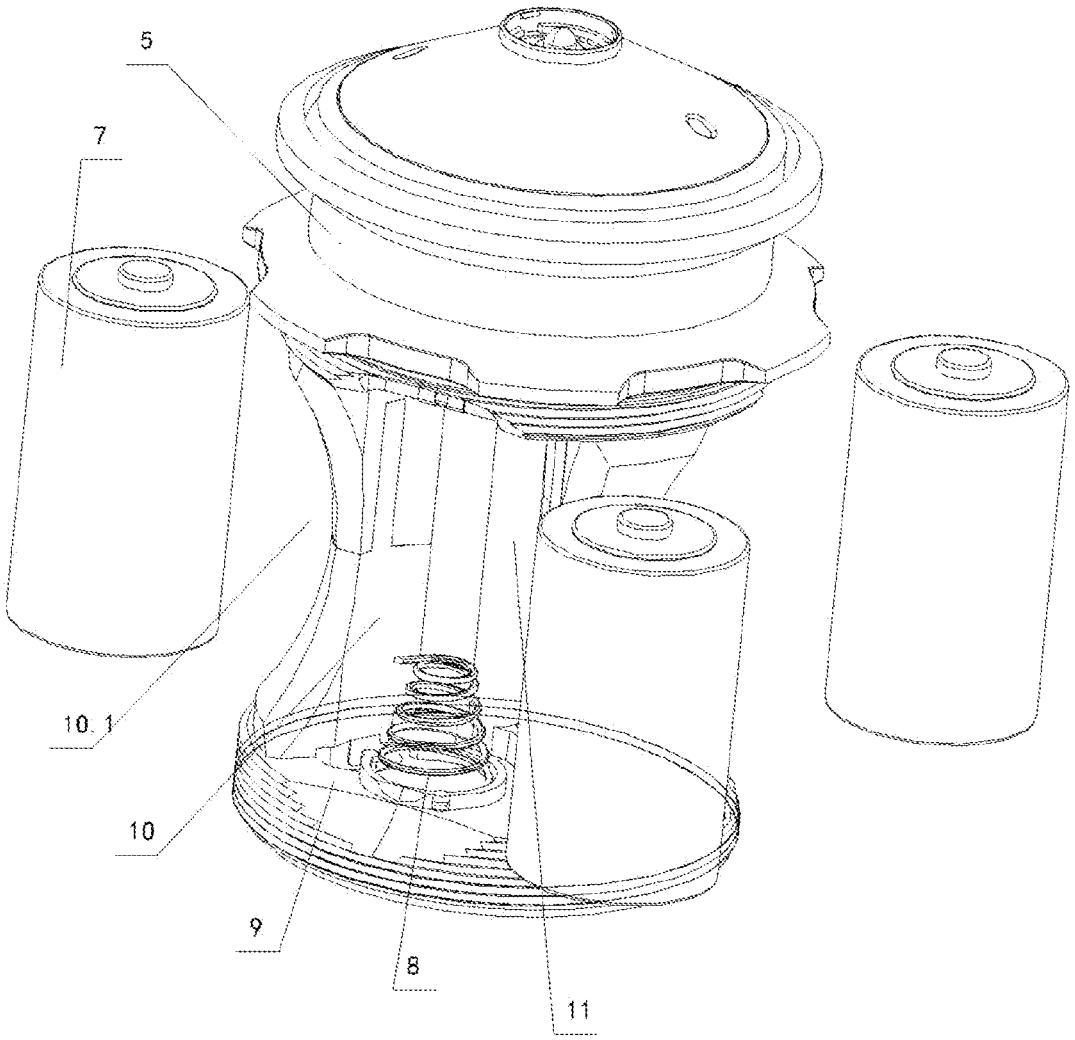
FIG. 4 is a schematic diagram showing the battery pack of the outdoor camping lamp according to the present invention.

As seen from the schematic diagram of FIGS. 1-4, an outdoor camping lamp according to the present invention comprises a handle 1, a top cover 2, a shade 3, a lamp socket assembly and a plurality of batteries 7. The handle 1 is mounted on the side wall of the top cover 2. The top cover 2 is connected to the upper end of the shade 3. The lower end of the shade 3 is connected to the upper end of the lamp socket assembly. A light emitting body 4 is mounted on the lamp socket assembly within the shade 3. A plurality of batteries 7 is arranged in the lamp socket assembly. The lamp socket assembly includes a lamp socket 5, a housing 6, a battery installing bracket and a bottom support 9. The upper end of the lamp socket 5 is connected to the lower end of the shade 3. The lower end of the lamp socket 5 is connected to the upper end of the housing 6. The upper end of the battery installing bracket is connected to the lower end surface of the lamp socket 5. The lower end of the battery installing bracket is connected to the upper end surface of the bottom support 9. Both the battery installing bracket and the bottom support 9 are arranged in the housing 6.

A boss 5.1 is provided at the lower end of the lamp socket 5. The outer periphery wall of the boss 5.1 has external thread. The upper end of the housing 6 has internal thread engaged to the external thread of the boss 5.1. The outer periphery wall of the bottom support 9 has external thread engaged to the internal thread at the upper end of the housing 6.

The battery installing bracket comprises a central column 11 and a plurality of spacers 10 in radial distribution. Both the upper ends of the central column 11 and the spacers 10 are connected to the lower end surface of the boss 5.1. Both the lower ends of the central column 11 and the spacers 10 are connected with the upper end surface of the bottom support 9. The number of the spacers 10 equals to the number of the batteries 7. Each battery 7 is sandwiched between two adjacent spacers 10, and each battery 7 is connected with the bottom support 9 via respective springs 8. The lower ends of the springs 8 are fixedly connected to the bottom support 9. In this embodiment, the number of the batteries 7 is three, the number of the corresponding spacers 10 is three, and the number of the springs 8 is also three.

A nick 10.1 is arranged at the side of each spacer 10 away from the central column 11.

A plurality of the lugs 6.1 is uniformly arranged at the outer periphery wall of the lower end of the housing 6 along the outer periphery.

The present invention is used as following steps: when the outdoor camping lamp is drained off and the batteries need to be replaced, the housing 6 is unscrewed from the boss 5.1 of the lamp socket 5 until the housing 6 is obstructed by the bottom support 9. At this time, the batteries on the battery installing bracket are exposed completely. Then, each battery 7 is taken off from the lateral side, and the new batteries 7 are sandwiched between the adjacent spacers 10 from the lateral side. The flat end of the battery 7 is downwards in contact with the spring 8, and the protrude end thereof is arranged upwards. After that, the housing 6 is slid upwards, and the boss 5.1 is screwed up. Then, the outdoor camping lamp can be used.

The invention claimed is:

1. An outdoor camping lamp, comprising a handle (1), a top cover (2), a shade (3), a lamp socket assembly, and a plurality of batteries (7), the handle(1) mounted on the side wall of the top cover (2), the top cover (2) connected to the upper end of the shade (3), the lower end of the shade (3) connected to the upper end of the lamp socket assembly, a light emitting body (4) mounted on the lamp socket assembly within the shade (3), the plurality of batteries (7) being in the lamp socket assembly, characterized in that: the lamp socket assembly comprises a lamp socket (5), a housing (6), a battery installing bracket and a bottom support (9), the upper end of the lamp socket (5) is connected with the lower end of the shade (3), the lower end of the lamp socket(5) is connected with the upper end of the housing (6), the upper end of the battery installing bracket is connected to the lower end surface of the lamp socket (5), and the lower end of the battery installing bracket is connected to the upper end surface of the bottom support (9); both of the battery installing bracket and the bottom support (9) are arranged in the housing (6), wherein:

a boss (5.1) is provided at the lower end of the lamp socket (5), an outer peripheral wall of the boss (5.1) has external thread, and the upper end of the housing (6) has internal thread engaged with the external thread of the boss (5.1); an outer periphery wall of the bottom support (9) has external thread engaged with the internal thread at a lower end of the housing (6), and the battery installing bracket includes a central column (11) and a plurality of spacers (10) in radial distribution, both the upper ends of the central column(11) and the spacers(10) are connected with the lower end surface of the boss (5.1), both the lower ends of the central column (11) and the spacers (10) are connected with the upper end surface of the bottom support(9); the number of the spacers(10) equals to the number of the batteries (7), each battery (7) is sandwiched between two adjacent spacers(10), each battery(7) is connected with the bottom support(9) via respective springs(8), and the lower ends of the springs (8) are fixedly connected to the bottom support (9).

2. The outdoor camping lamp according to claim 1, characterized in that: a nick (10.1) is arranged at the side of each spacer (10) away from the central column (11).

3. The outdoor camping lamp according to claim 1, characterized in that: a plurality of lugs (6.1) are uniformly arranged at the outer periphery wall of the lower end of the housing (6) along the outer periphery.

* * * * *